US009677394B2

(12) United States Patent
Wang et al.

(10) Patent No.: US 9,677,394 B2
(45) Date of Patent: Jun. 13, 2017

(54) DOWNHOLE FLUID SENSOR WITH CONDUCTIVE SHIELD AND METHOD OF USING SAME

(71) Applicant: Schlumberger Technology Corporation, Sugar Land, TX (US)

(72) Inventors: Cong Wang, Sagamihara (JP); Akira Kamiya, Sagamihara (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 554 days.

(21) Appl. No.: 13/929,789

(22) Filed: Jun. 28, 2013

(65) Prior Publication Data

US 2015/0000977 A1 Jan. 1, 2015

(51) Int. Cl.

| | |
|---|---|
| ***E21B 47/00*** | (2012.01) |
| ***E21B 49/10*** | (2006.01) |
| ***E21B 47/01*** | (2012.01) |

(52) U.S. Cl.

CPC ..... *E21B 47/00* (2013.01); *E21B 47/01* (2013.01); *E21B 49/10* (2013.01)

(58) Field of Classification Search

USPC ..... 324/303, 366, 324, 453

See application file for complete search history.

(56) References Cited

U.S. PATENT DOCUMENTS

| | | | | |
|---|---|---|---|---|
| 3,305,771 | A | 2/1967 | Arps | |
| 5,070,725 | A | 12/1991 | Cox et al. | |
| 5,095,758 | A | 3/1992 | Cox et al. | |
| 5,721,492 | A | 2/1998 | Saenger | |
| 7,140,434 | B2 | 11/2006 | Chouzenoux et al. | |
| 7,183,778 | B2 | 2/2007 | Homan et al. | |
| 7,242,194 | B2 | 7/2007 | Hayman et al. | |
| 7,458,252 | B2 | 12/2008 | Freemark et al. | |
| 7,986,144 | B2 | 7/2011 | He et al. | |
| 2007/0018659 | A1* | 1/2007 | Homan | G01V 3/20 324/693 |
| 2009/0090176 | A1 | 4/2009 | Toribio et al. | |
| 2010/0089569 | A1* | 4/2010 | van Zuilekom | E21B 43/38 166/250.01 |
| 2012/0055672 | A1 | 3/2012 | Tollefsen et al. | |

(Continued)

FOREIGN PATENT DOCUMENTS

| | | |
|---|---|---|
| WO | 2010/008994 | 1/2010 |

OTHER PUBLICATIONS

Examination report for the equivalent Australian patent application No. 2014203431 issued on Aug. 21, 2015.

*Primary Examiner* — Caroline Butcher

(57) ABSTRACT

A fluid sensor for a downhole tool positionable in a wellbore penetrating a subterranean formation. The downhole tool has a housing with a flowline therethrough receiving a downhole fluid therein. The fluid sensor includes an insulative base positionable in the downhole tool, a conductive shield positionable on the insulative base, and a plurality of electrodes each having a non-conductive coating thereon. Each of the electrodes includes a sensing element and a pin. The sensing element is positionable in the insulative base and exposed to the downhole fluid passing through the flowline. The pin operatively connects the sensing element to a downhole unit whereby parameters of the downhole fluid are measured.

16 Claims, 9 Drawing Sheets

(56) References Cited

U.S. PATENT DOCUMENTS

| | | | | |
|---|---|---|---|---|
| 2012/0096935 | A1* | 4/2012 | Finke | E21B 47/01 73/152.03 |
| 2012/0132544 | A1 | 5/2012 | Lawrence et al. | |
| 2013/0002258 | A1 | 1/2013 | Ligneul et al. | |
| 2013/0037263 | A1 | 2/2013 | Cheung | |

* cited by examiner

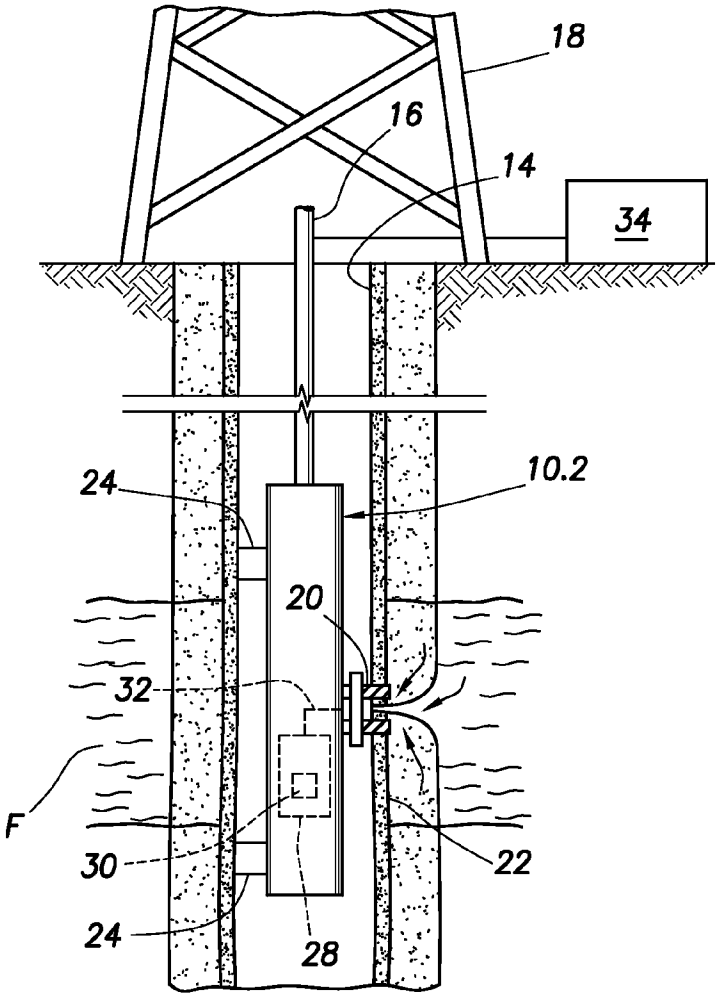
FIG. 1.2
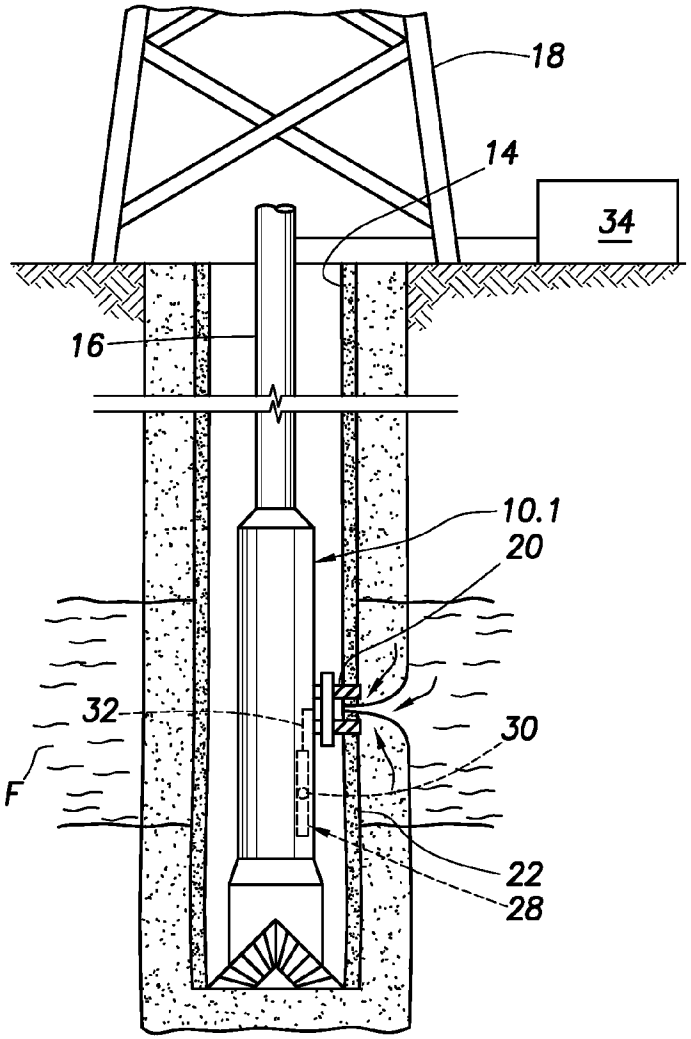
FIG. 1.1

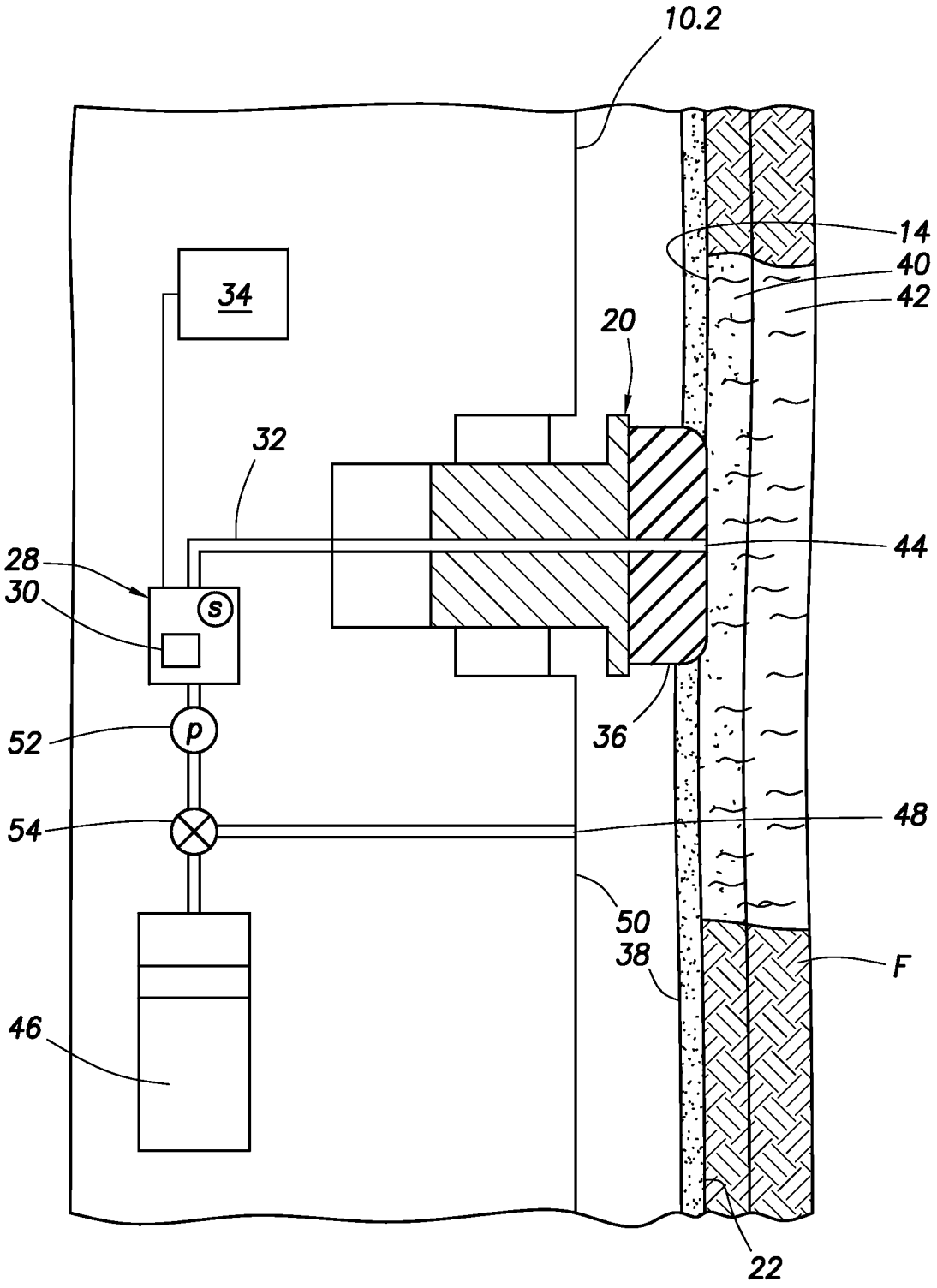
FIG.2.1

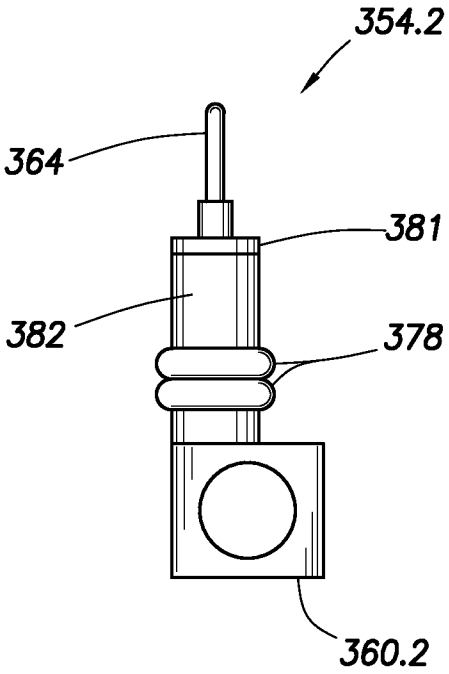
FIG.5.3
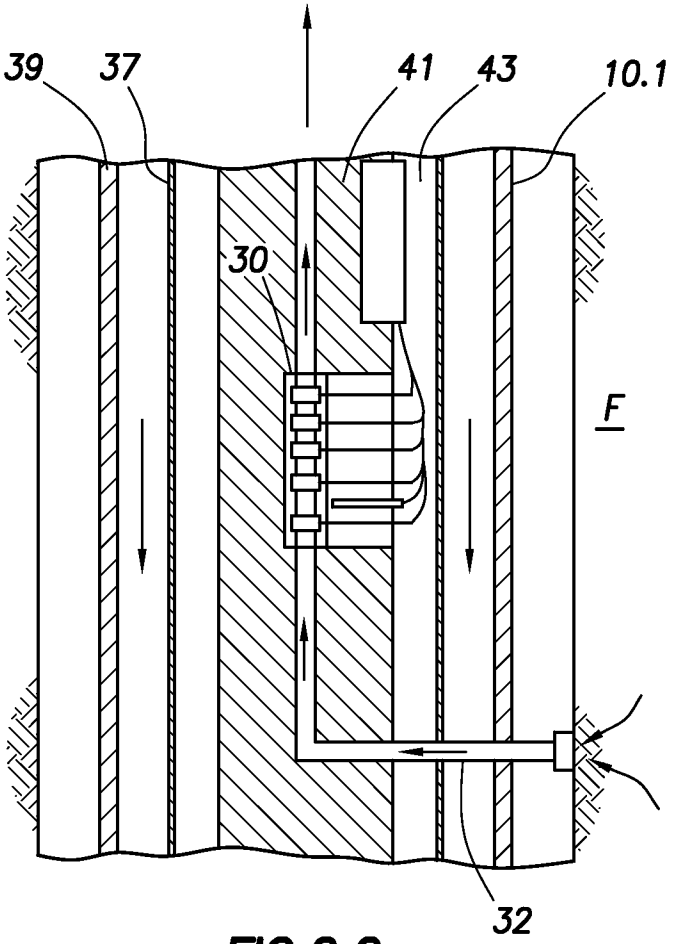
FIG.2.2

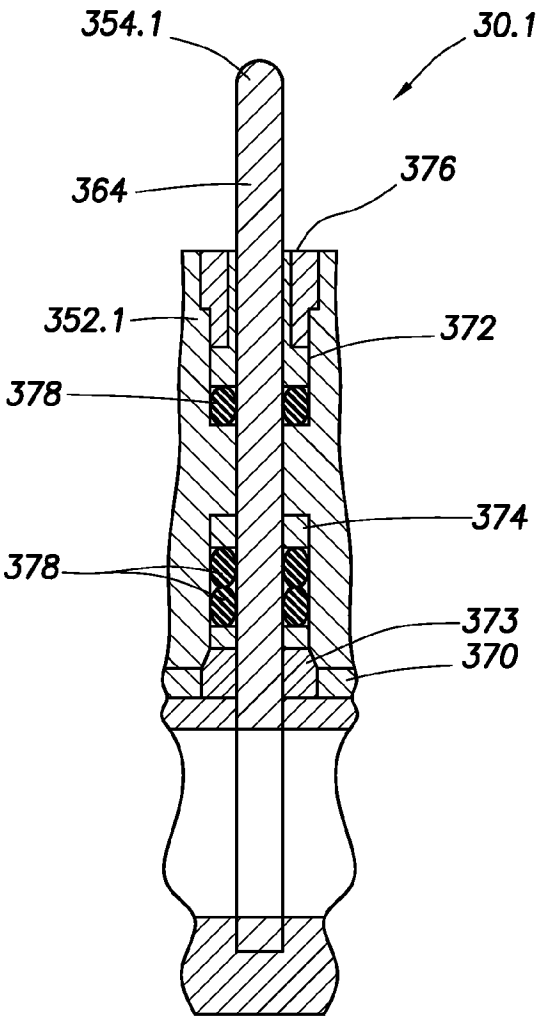
FIG.4.2
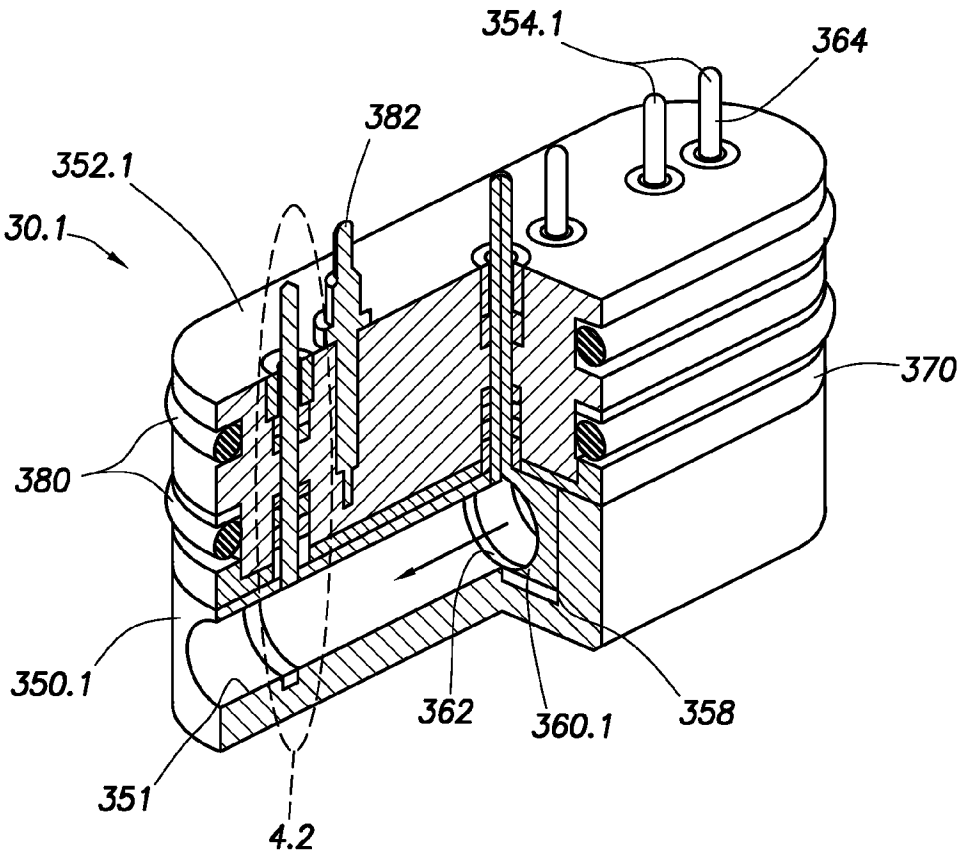
FIG.4.1

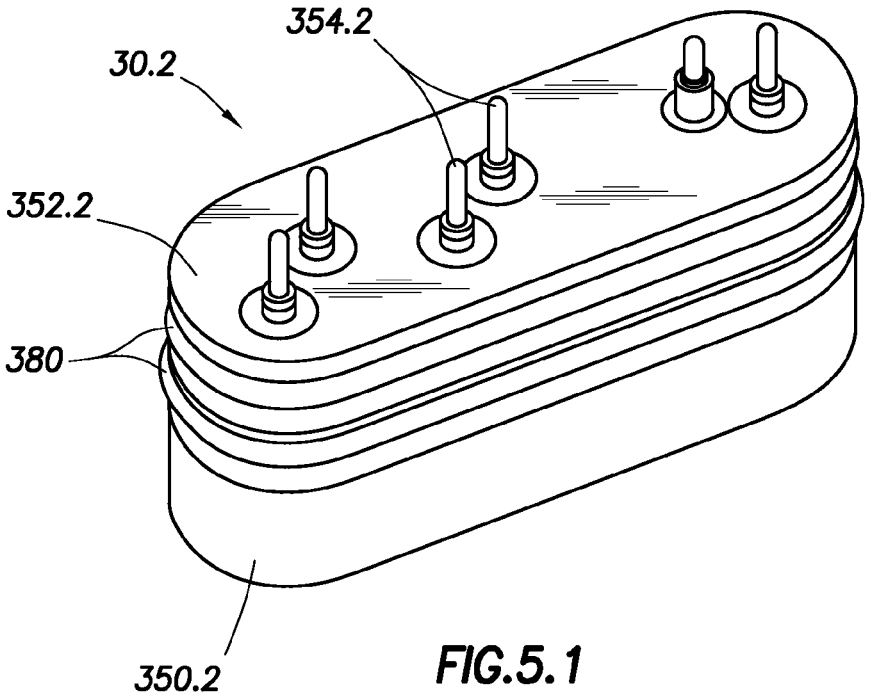
FIG.5.1
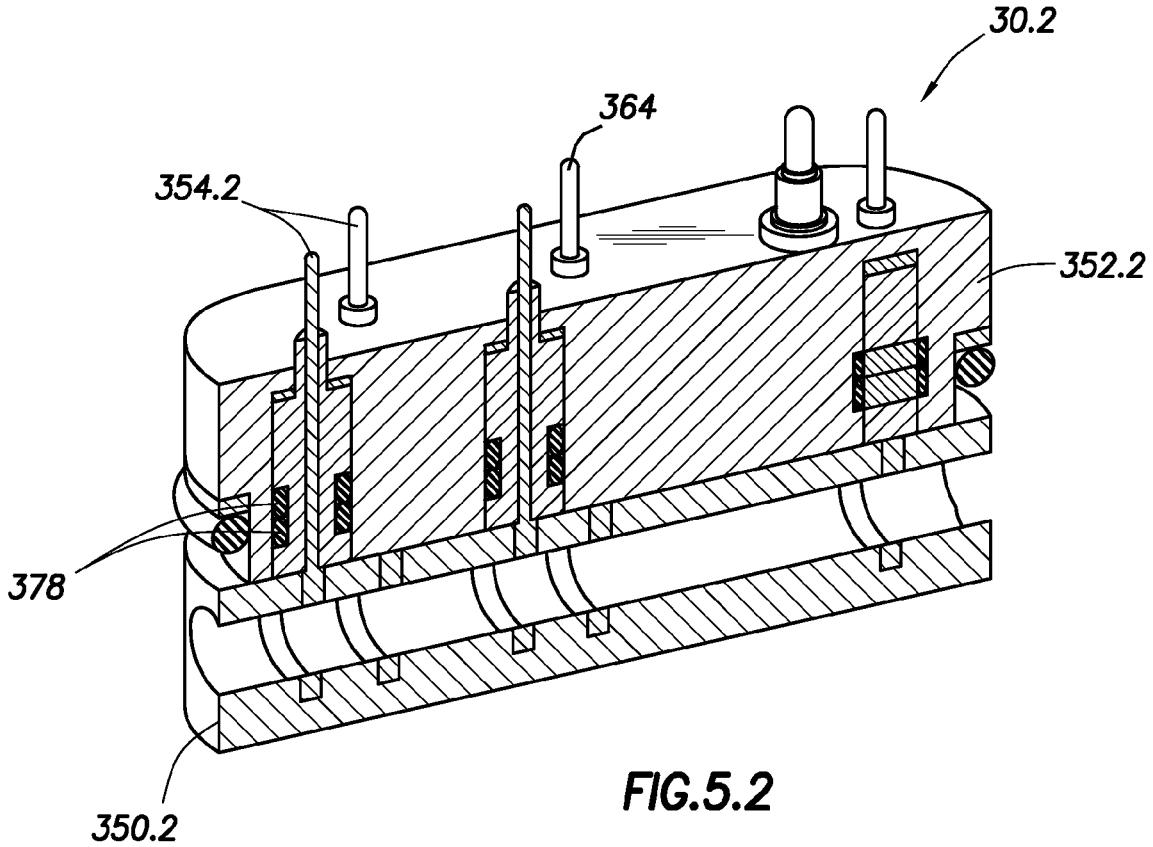
FIG.5.2

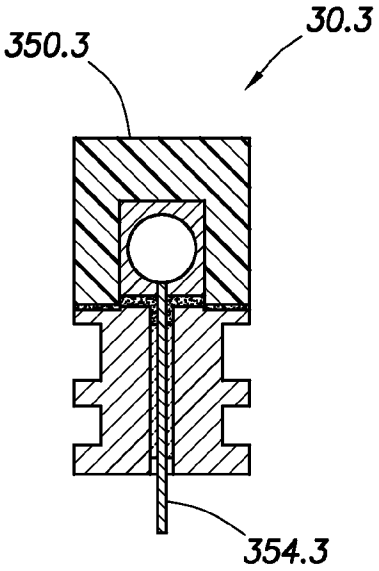
FIG.6.4
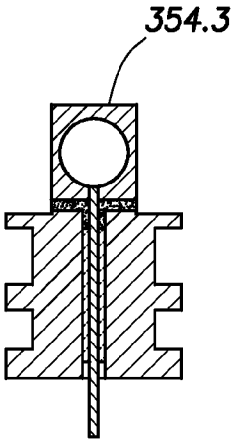
FIG.6.3
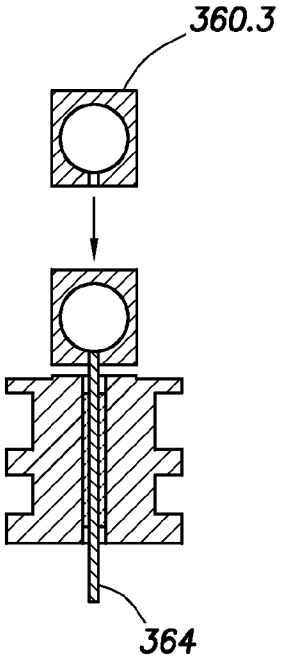
FIG.6.2
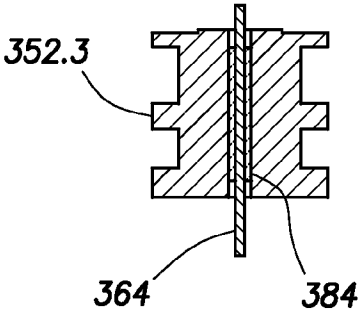
FIG.6.1

DOWNHOLE FLUID SENSOR WITH CONDUCTIVE SHIELD AND METHOD OF USING SAME

BACKGROUND

The present disclosure relates generally to wellsite operations. In particular, the present disclosure relates to formation evaluation involving testing, measuring, sampling, monitoring and/or analyzing downhole fluids.

Wellbores are drilled to locate and produce hydrocarbons. A downhole drilling tool with a bit at an end thereof is advanced into the ground to form a wellbore. As the drilling tool is advanced, drilling mud is pumped through the drilling tool and out the drill bit to cool the drilling tool and carry away cuttings. The fluid exits the drill bit and flows back up to the surface for recirculation through the drilling tool. The drilling mud is also used to form a mudcake to line the wellbore.

During or after a drilling operation, various downhole evaluations may be performed to determine characteristics of the wellbore and surrounding formations. In some cases, the drilling tool may be provided with devices to test and/or sample the surrounding formation and/or fluid contained in reservoirs therein. In some cases, the drilling tool may be removed and a downhole wireline tool may be deployed into the wellbore to test and/or sample the formation. These samples or tests may be used, for example, to determine whether valuable hydrocarbons are present. Production equipment may be positioned in the wellbore to draw located hydrocarbons to the surface.

Formation evaluation may involve drawing fluid from the formation into the downhole tool for testing and/or sampling. Various devices, such as probes or packers, may be extended from the downhole tool to establish fluid communication with the formation surrounding the wellbore and to draw fluid into the downhole tool. Downhole tools may be provided with fluid analyzers and/or sensors to measure downhole parameters, such as fluid properties. Examples of downhole tools are provided in U.S. Pat. No. 7,458,252, the entire contents of which are hereby incorporated by reference. The downhole tool may also be provided with sensors for measuring downhole parameters. Examples of sensors are provided in patent/publication Nos. US2012/0132544 and U.S. Pat. No. 7,183,778, the entire contents of which are hereby incorporated by reference.

SUMMARY

In one aspect, the disclosure relates to a fluid sensor for a downhole tool positionable in a wellbore penetrating a subterranean formation. The downhole tool has a housing with a flowline therethrough receiving downhole fluid therein. The fluid sensor includes an insulative base positionable in the downhole tool, a conductive shield positionable on the insulative base, and a plurality of electrodes each having a non-conductive coating thereon. Each of the electrodes includes a sensing element and a pin. The sensing element is positionable in the insulative base and exposed to the downhole fluid passing through the flowline. The pin operatively connects the sensing element to a downhole unit whereby parameters of the downhole fluid are measured.

In another aspect, the disclosure relates to a downhole tool positionable in a wellbore penetrating a subterranean formation. The downhole tool includes a housing with a flowline therethrough, a downhole unit, and a fluid sensor positionable in the housing. The fluid sensor includes an insulative base positionable in the downhole tool, a conductive shield positionable on the insulative base, and a plurality of electrodes each having a non-conductive coating thereon. Each of the electrodes includes a sensing element and a pin. The sensing element is positionable in the insulative base and exposed to the downhole fluid passing through the flowline. The pin operatively connects the sensing element to a downhole unit whereby parameters of the downhole fluid are measured.

In still another aspect, the disclosure relates to a method of sensing downhole parameters of a fluid about a wellbore penetrating a subterranean formation. The method involves deploying a downhole tool into the wellbore. The downhole tool includes a housing with a flowline therethrough, a downhole unit, and a fluid sensor positionable in the housing. The fluid sensor includes an insulative base positionable in the downhole tool, a conductive shield positionable on the insulative base, and a plurality of electrodes each having a non-conductive coating thereon. The method also involves passing a fluid through the flowline and past the electrodes, and measuring downhole parameters of the fluid with the electrodes.

In yet another aspect, the disclosure relates to a fluid sensor for a downhole tool positionable in a wellbore penetrating a subterranean formation. The downhole tool has a housing with a flowline therethrough receiving a downhole fluid therein. The fluid sensor includes a plurality of electrodes and an insulative base. Each of the electrodes includes a sensing element and a pin. The insulative base is integrally formed with the electrodes therein such that the insulative base is positionable in the downhole tool and has a passage in fluid communication with the flowline to pass the downhole fluid therethrough. The electrodes are formed within the insulative base such that the sensing element is exposed to the downhole fluid passing through the flowline and the pin operatively connects the sensing element to a downhole unit whereby parameters of the downhole fluid are measured.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of downhole fluid sensors with conductive shield and methods of using the same are described with reference to the following figures. The same numbers are used throughout the figures to reference like features and components.

FIGS. 1.1 and 1.2 depict schematic views, partially in cross-section, of a wellsite with a downhole drilling tool and a downhole wireline tool, respectively, deployed into a wellbore for performing downhole formation evaluation in accordance with embodiments of the present disclosure;

FIGS. 2.1 and 2.2 depict schematic views of a portion of a downhole wireline tool and a downhole drilling tool, respectively, having a fluid sensor therein in accordance with embodiments of the present disclosure;

FIGS. 4.1-4.2 are schematic, perspective partial cross-sectional and vertical cross-sectional views, respectively, of a fluid sensor with conductive shield in accordance with embodiments of the present disclosure;

FIGS. 5.1-5.3 are schematic perspective, and cross-sectional and detailed views, respectively, of a fluid sensor with conductive shield and offset electrode in accordance with embodiments of the present disclosure;

FIGS. 6.1-6.4 are schematic, cross-sectional views of a fluid sensor with glass seal in various stages of assembly in accordance with embodiments of the present disclosure;

DETAILED DESCRIPTION

Figure 3:
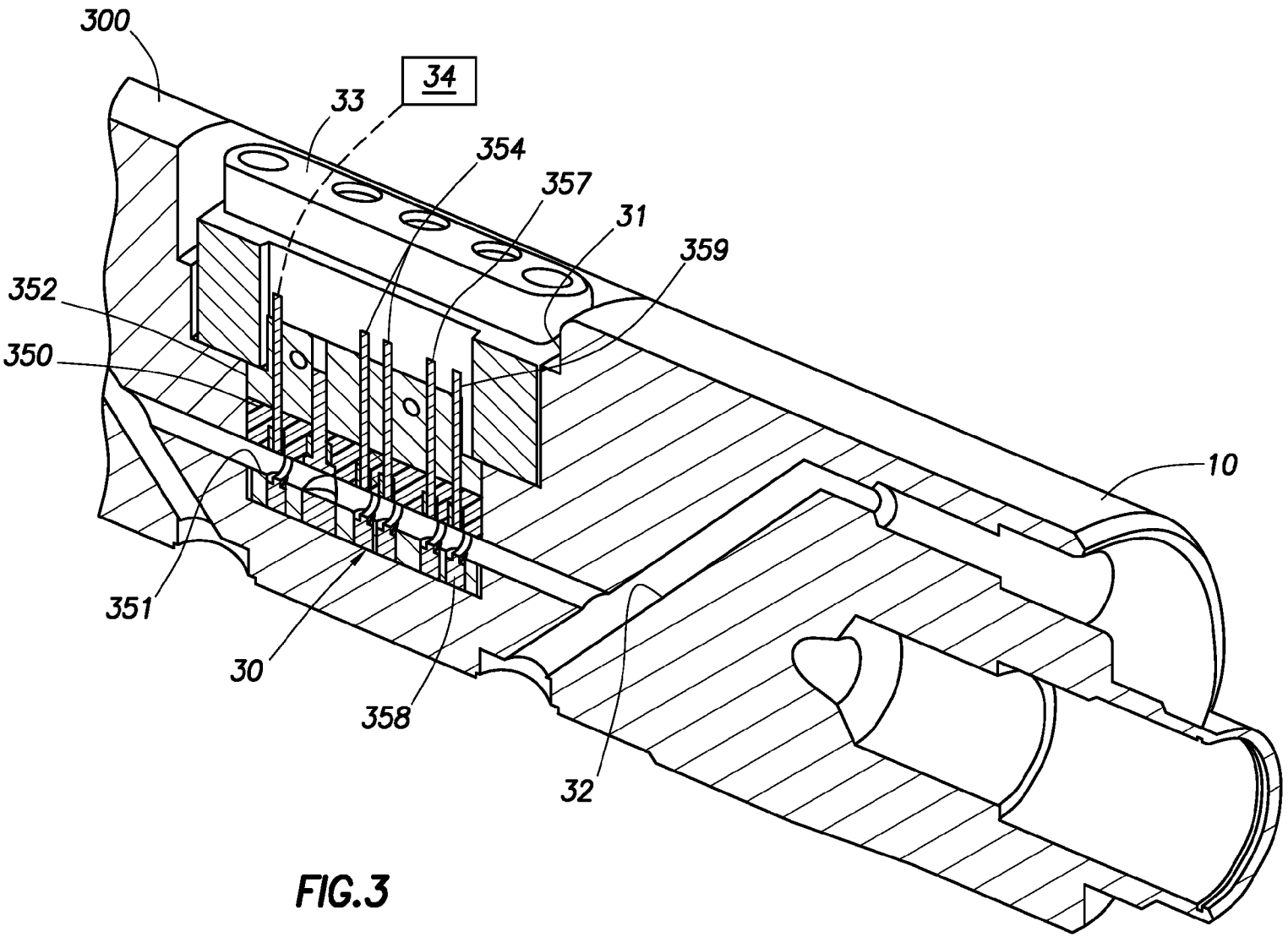
FIG. 3 is a schematic, perspective, cross-sectional view illustrating a portion of a downhole tool having a fluid sensor positioned about a flowline therein in accordance with embodiments of the present disclosure.

The description that follows includes exemplary systems, apparatuses, methods, techniques, and instruction sequences that implement techniques of the inventive subject matter. However, it is understood that the described embodiments may be practiced without these specific details.

The present disclosure relates to a downhole fluid sensor positionable about a downhole tool for measuring parameters of downhole fluids. The fluid sensor includes an insulative base and a conductive shield with a plurality of electrodes extending therethrough. The electrodes have an insulative coating thereabout to electrically isolate the electrodes about the conductive shield. The fluid sensor may have various configurations, such as an eccentric (or offset) electrode, glass seal, and/or an integrally molded insulative base, and be provided with various non-conductive features, such as centralizers, rings, caps, o-rings and others.

'Formation evaluation' as used herein relates to the measurement, testing, sampling, and/or other analysis of wellsite materials, such as gases, fluids and/or solids. Such formation evaluation may be performed at a surface and/or downhole location to provide data, such as downhole parameters (e.g., temperature, pressure, permeability, porosity, seismic, etc.), material properties (e.g., viscosity, composition, density, etc.), and the like.

'Fluid analysis' as used herein relates to a type of formation evaluation of downhole fluids, such as wellbore, formation, reservoir, and/other fluids located at a wellsite. Fluid analysis may be performed by a fluid analyzer which is capable of measuring fluid properties, such as viscosity, composition, density, temperature, pressure, flow rate, optical parameters, etc. Fluid analysis may be performed using, for example, optical sensors (e.g., spectrometers), gauges (e.g., quartz), densitometers, viscometers, resistivity sensors, nuclear sensors, and/or other fluid measurement and/or detection devices.

FIGS. 1.1 and 1.2 depict environments in which subject matter of the present disclosure may be implemented. FIG. 1.1 depicts a downhole drilling tool 10.1 and FIG. 1.2 depicts a downhole wireline tool 10.2 that may be used for performing formation evaluation. The downhole drilling tool 10.1 may be advanced into a subterranean formation F to form a wellbore 14. The downhole drilling tool 10.1 may be conveyed alone or among one or more (or itself may be a) measurement-while-drilling (MWD) drilling tool, a logging-while-drilling (LWD) drilling tools, or other drilling tools. The downhole tool 10.1 is attached to a conveyor (e.g., drillstring) 16 which is driven by a rig 18 to form the wellbore 14. The downhole tool 10.1 includes a probe 20 that is adapted to seal with a wall 22 of the wellbore 14 to draw fluid from the formation F into the downhole tool 10.1 as depicted by the arrows.

The downhole drilling tool 10.1 may be withdrawn from the wellbore 14, and the downhole wireline tool 10.2 of FIG. 1.2 may be deployed from the rig 18 into the wellbore 14 via conveyance (e.g., a wireline cable) 16. The downhole wireline tool 10.1 is provided with the probe 20 which is adapted to seal with the wellbore wall 22 and draw fluid from the formation F into the downhole tool 10.2. Backup pistons 24 may be used to assist in pushing the downhole tool 10.2 and probe 20 against the wellbore wall 22 and adjacent the formation F.

The downhole tools 10.1, 10.2 may be also provided with a formation evaluation tool 28 with a fluid sensor 30 for measuring parameters of the formation fluid drawn into the downhole tool 10.1, 10.2. The formation evaluation tool 28 includes a flowline 32 for receiving the formation fluid from the probe 20 and passing the fluid to the fluid sensor 30 for measurement as will be described more fully herein. A surface unit 34 may be provided to communicate with the downhole tool 10.1, 10.2 for passage of signals (e.g., data, power, command, etc.) therebetween.

While FIGS. 1.1 and 1.2 depict specific types of downhole tools 10.1 and 10.2, any downhole tool that is capable of performing formation evaluation may be used, such as drilling, coiled tubing, wireline or other downhole tool. Also, while FIGS. 1.1 and 1.2 depict one fluid sensor 30 in a downhole tool, it will be appreciated that one or more fluid sensors 30 and/or other sensors may be positioned at various locations about the downhole tool and/or wellbore. Data and test results obtained from various locations and/or using various methods and/or apparatuses may be analyzed and compared.

FIG. 2.1 is a schematic view of a portion of downhole tool 10.2 depicting the fluid sensor 30 therein. The probe 20 may be extended from the downhole tool 10.2 for engagement with the wellbore wall 22. The probe is provided with a packer 36 for sealing with the wellbore wall 22. Packer 36 contacts the wellbore wall 22 and forms a seal with a mudcake 38 lining the wellbore wall 22. A mud filtrate of the mudcake 38 seeps into the wellbore wall 22 and creates an invaded zone 40 about the wellbore 14. The invaded zone 40 contains the mud filtrate and other wellbore fluids that may contaminate surrounding formations, such as formation F, and a portion of clean formation fluid 42 from the formation F.

The formation evaluation tool 28 may be provided with one or more flowlines 32 for drawing fluid into the downhole tool 10 through an inlet 44 in the probe 20. While one probe 20 with one inlet 44 is depicted, one or more probes, dual packers and related inlets may be provided to receive downhole fluids and pass them to one or more flowlines 32. Examples of downhole tools and fluid communication devices, such as probes, that may be used are depicted in U.S. Pat. No. 7,458,252, previously incorporated herein.

The flowline 32 extends into the downhole tool 10 to pass downhole fluid to the formation evaluation tool 28. The formation evaluation tool 28 may be used to analyze, test, sample and/or otherwise evaluate the downhole fluid.

The fluid sensor 30 is positioned about the flowline 32 and exposed to the downhole fluid passing therethrough. A sample chamber 46 is also coupled to the flowline 32 for receiving the downhole fluid. Fluid collected in the sample chamber 46 may be collected therein for retrieval at the surface, or may be exited through an outlet 48 in housing 50 of the downhole tool 10.

One or more downhole sensors S may optionally be provided to measure various downhole parameters and/or fluid properties. The downhole sensor(s) may include, for example, gauges (e.g., quartz), densitometers, viscometers, resistivity sensors, nuclear sensors, and/or other measurement and/or detection devices capable of taking downhole data relating to, for example, downhole conditions and/or fluid properties.

Optionally, flow of the downhole fluid into and/or through the downhole tool 10 may be manipulated by one or more flow control devices, such as a pump 52, the sample chamber 46, valves 54 and/or other devices. Optionally, a surface and/or downhole unit 34 may be provided to communicate with the formation evaluation tool 28, the fluid sensor 30, and/or other portions of the downhole tool 10 for the passage of signals (e.g., data, power, command, etc.) therebetween. These units 34 may include, for example, a measurement while drilling tool, a logging while drilling tool, a processor, a controller, a transceiver, a power source and other features for operating and/or communication with the formation evaluation tool 28 and/or the fluid sensor 30.

FIG. 2.2 shows another view of the fluid sensor 30 in a portion of the drilling tool 10.1. As shown in this view, the downhole tool 10.1 may have a housing 37 supported in a drill collar 39 of the drilling tool 10.2. Drilling mud passes between the housing 37 and the drill collar 39 as indicated by the downward arrows. The housing 37 has a chassis 41 surrounded by an air section 43.

The flowline 32 extends through the drill collar 39, housing 37, air section 43 and chassis 41. The fluid sensor 30 is supported in the chassis 41 and the air section 43 with a portion of the fluid sensor 30 extending into the flowline 32 for exposure to the fluid passing therethrough. As shown, the fluid sensor 30 is positioned for measurement of fluid from formation F that passes into the flowline 32 as indicated by the arrows.

FIG. 3 is another view of a portion of downhole tool 10, which may be the downhole tool 10.1 or 10.2 of FIG. 1.1 or 1.2. As shown in this cross-sectional view, the fluid sensor 30 is positioned in the downhole tool 10 about flowline 32. The downhole tool 10 has a receptacle 31 extending through a housing (or chassis) 300 of the downhole tool 10 to receive the fluid sensor 30.

The fluid sensor 30 is positioned in the receptacle 31 and through the flowline 32. A cell cap 33 is positioned on the fluid sensor 30 to retain and protect the fluid sensor 30 in the downhole tool 10. The fluid sensor 30 has a passage 351 therethrough in fluid communication with the flowline 32 for passing fluid therethrough. In this configuration, the fluid sensor 30 is positioned to measure properties of the fluid passing through flowline 32 and passage 351.

The fluid sensor 30 has an insulative base 350, a conductive shield (or outer layer) 352 with electrodes 354 extending therethrough. The insulative base 350 comprises an insulative material, such as PEEK (polyether ether ketone), to support the electrodes 354 therein. The insulative base 350 has the flow passage 351 therethrough. The conductive shield 352 is positioned on the insulative base 350 and comprises a hard, conductive material, such as metal (e.g., INCONEL™), to support and protect the electrodes 354 therein. The conductive shield 352 may be provided as a protective layer between the cell cap 33 and the insulative base 350.

The electrodes 354 are positioned through the conductive shield 352 with an exterior end 357 thereof extending into the cell cap 33. A sensing end 358 of the electrodes 354 is positionable about the passage 351 for measurement of the fluid passing therethrough. The electrodes 354 may be electrically connected to a surface and/or downhole unit 34 as schematically depicted. An insulative coating 359 is provided about the electrodes 354 as will be described more fully herein.

FIGS. 4.1-7 show various versions of fluid sensors 30.1-30.4 that may be used as the fluid sensor 30 of FIGS. 1.1-3. Each version of the fluid sensor 30.1-30.4 includes an insulative base 350.1-350.4 and electrodes 354.1-354.4. Various other features and configurations are provided in the various versions of the fluid sensors 30.1-30.4.

FIGS. 4.1-4.2 show views of the fluid sensor 30.1 with the insulative base 350.1 and conductive shield 352.1. The fluid sensor 30.1 has an oval shape with electrodes 354.1 linearly distributed along the fluid sensor 30.1. Electrodes 354.1 extend from the insulative base 350.1, through the conductive shield 354.1, and into the cell cap 33 (FIG. 3).

The sensing end 358 of each electrodes 354.1 includes a sensing element 360.1 having a hole 362 in fluid communication with the passage 351 for measuring fluid passing therethrough. A pin 364 of electrodes 354.1 extends from each sensing element 360.1 through the conductive shield 352.1. The pin 364 extends from a central portion of the sensing element 360.1 in an aligned configuration.

In the version of FIGS. 4.1 and 4.2, various features have been added to the sensing element 360.1 to support and/or protect the electrodes 354.1. The sensing element 360.1 may include one or more electrode supports, such as a centralizer support 370, centralizers 372 and 373, ring 374, and threaded cap 376 as shown. The various electrode supports may be of an insulative material to prevent conductivity between the conductive shield 352.1 and the electrodes 354.1. The electrode supports may also be positioned between the electrodes 354.1 and the conductive shield 352.1 to provide structural support. The electrodes 354.1 may also be coated with an insulated material, such as TEFLON™, for example, to prevent electrical conductivity with the conductive shield 354.1.

The centralizer support 370 may be a layer adhered to the insulative base 350.1 and shaped to receive the conductive shield 352.1. A centralizer 372 may be positioned between the centralizer support 370 and the electrode 354.1. The threaded cap 376 may be positioned in the conductive shield 350.1 about the exterior end 357 of the electrodes 354.1. One or more centralizers 373 may be positioned between the threaded cap 376 and the conductive shield 352.1. One or more back up rings 374 may be provided between the electrodes 354.1 and the conductive shield 352.1 to provide additional support.

One or more interior o-rings 378 or other sealing devices may be positioned along the electrode 354.1 to provide fluid isolation along the electrode 354.1 to prevent fluid passage between the conductive shield 352.1 and the insulative layer 350.1. One or more exterior o-rings 380 may also be provided about a perimeter of the conductive shield to provide fluid isolation between the fluid sensor 30.1 and the downhole tool 10 when installed (see, e.g., FIG. 3).

The fluid sensor 30.1 is depicted as having five electrodes 354.1, but one or more may be provided. The electrodes 354.1 may be used for measuring fluid properties of the fluid passing through passage 351. The fluid sensor 30.1 may also be provided with other sensors capable of taking downhole measurements, such as temperature, pressure, composition, viscosity, etc. As shown, a temperature sensor 382 is also provided in the conductive shield 352.1.

FIGS. 5.1-5.3 show views of the fluid sensor 30.2 with the insulative base 350.2 and conductive shield 352.2 with electrodes 354.2 extending therethrough. FIGS. 5.1 and 5.2 show perspective and cross-sectional views, respectively, of the fluid sensor 30.2. FIG. 5.3 shows a the electrode 354.2 removed from the fluid sensor 30.2 of FIGS. 5.1 and 5.2. The fluid sensor 30.2 may be similar to the fluid sensor 30.1 of FIGS. 4.1-4.2, except that electrodes 354.2 have an offset configuration and are distributed non-linearly along the fluid sensor 30.2.

As shown in FIG. 5.3, the electrodes 354.2 have an offset sensing element 360.2 which may be integrally formed with pin 364 (e.g., by pressure fit). Additionally, the electrodes 354.2 are surrounded by electrode supports in the form of an insulative molding 382 and with a ring support 381 thereon. The ring support 381 may be metal to protect and retain the electrode 354.2 and/or the insulative molding 382 in position. O-rings 378 and 380 may also be provided about the conductive shield 352.2 for forming a seal within conductive shield 352.2.

FIGS. 6.1-6.4 show views of the fluid sensor 30.3 at various stages of fabrication. The fluid sensor 30.3 includes a conductive shield 352.3 and an insulative base 350.3 with electrodes 354.3 extending therethrough. The fluid sensor 30.3 may be similar to the fluid sensor 30.1 of FIGS. 4.1-4.2, except that, in this version, the conductive shield 352.3 forms the body of the fluid sensor 30.1 with a sensing element 360.3 adhered (e.g., by glue) thereto. Additionally, electrodes 354.3 include a separate pin 364 welded to the sensing element 360.3, and the sensing element 360.3 is positioned in the molded insulative base 350.3. The electrodes 354.3 are surrounded by electrode supports in the form of a glass seal 384 positioned between the electrode 354.3 and the conductive shield 352.3.

As shown by the sequence depicted in FIGS. 6.1-6.4, the fluid sensor 30.3 may be formed by inserting a pin 364 into a glass seal 384 within conductive shield 352.3. The sensing element 360.3 may then be adhered to the pin 364 to form the electrode 354.3. The insulative base 350.3 may then be molded about the sensing element 360.3.

Figure 7:
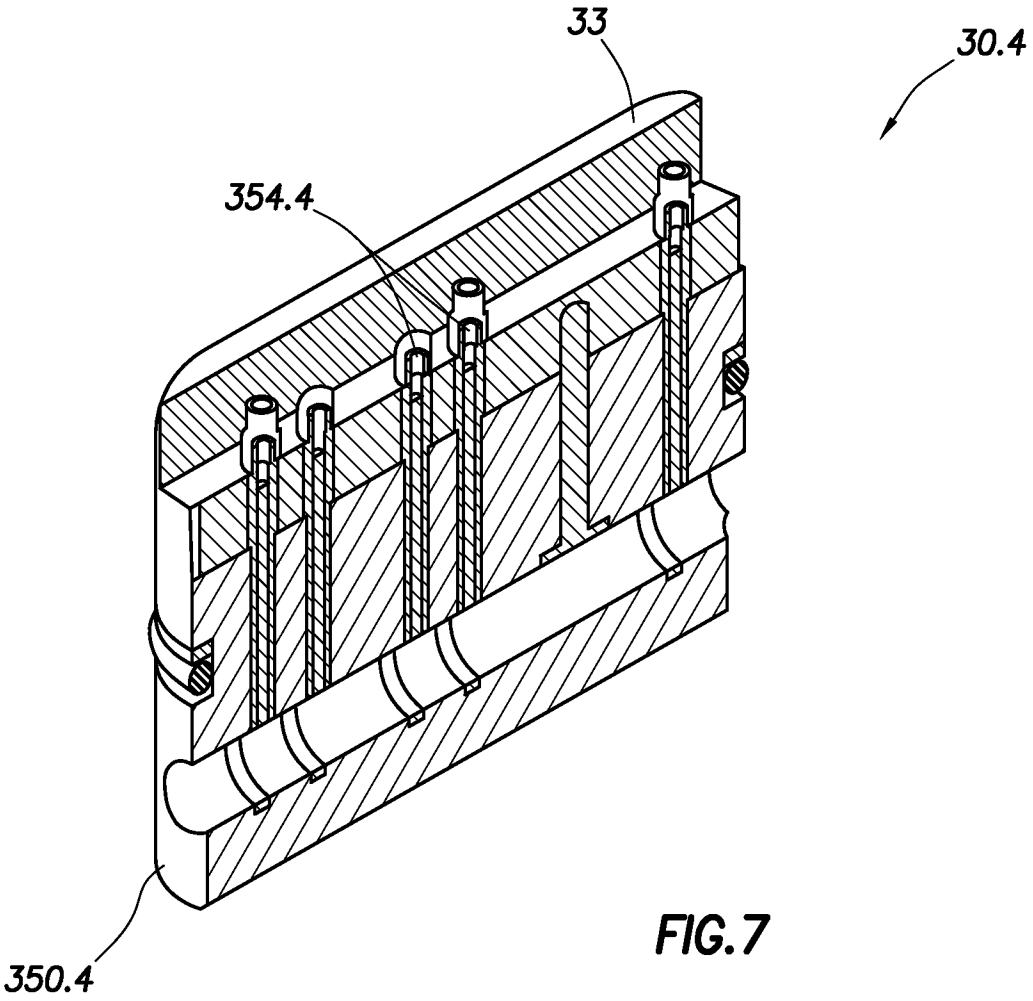
FIG. 7 is a schematic, cross-sectional view of a fluid sensor with a molded insulative base in accordance with embodiments of the present disclosure.

FIG. 7 shows a cross-sectional view of the fluid sensor 30.4 with the cell cap positioned thereon. The fluid sensor 30.4 includes a molded insulative base 350.4 with electrodes 354.4 extending therethrough. The fluid sensor 30.4 may be similar to the fluid sensor 30.1 of FIGS. 4.1-4.2, except that, in this version, the insulative layer 350.4 is molded to form the body of the fluid sensor 30.4. Additionally, electrodes 354.4 may be molded into the insulative layer 350.4. The insulative layer 350.4 may be molded for connection to the cell cap 33. As demonstrated by this figure, the fluid sensor 30.3 may be formed by molding the insulative base 350.4 about the electrodes 354.4.

While the figures herein depict specific configurations of a fluid sensor 30-30.4, various features of certain sensors may be provided on other sensors. For example, certain centralizers, supports or o-rings may be provided about any of the provided fluid sensors 30.1-30.4. One or more of various types of the fluid sensors 30-30.4 may be provided in the downhole tool. One or more additional sensors capable of measuring other downhole parameters may also be provided.

Figure 8:
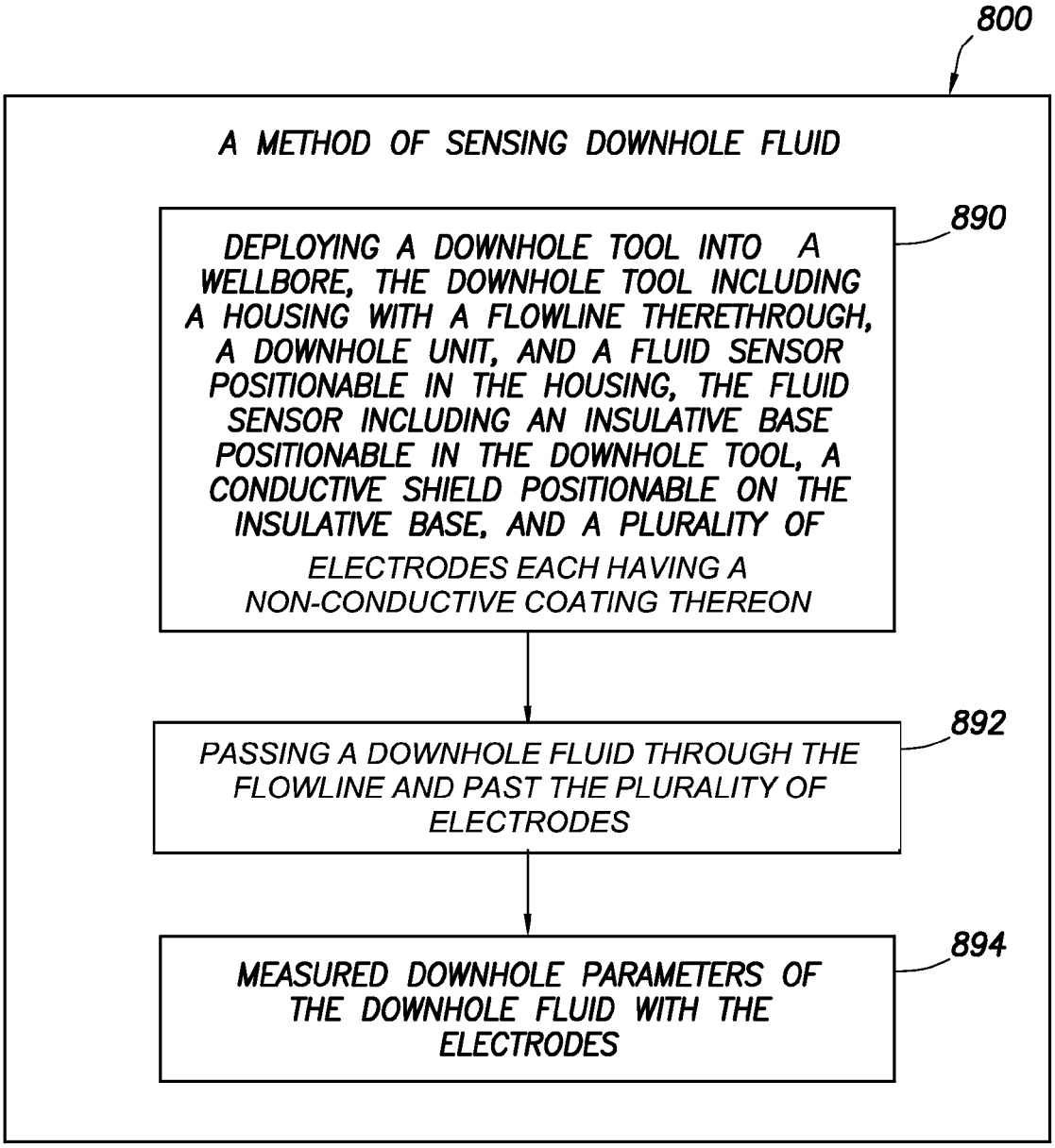
FIG. 8 is a flow chart illustrating a method of sensing downhole parameters in accordance with embodiments of the present disclosure.

FIG. 8 shows an example method 800 of measuring downhole parameters. The method involves 890—deploying a downhole tool into the wellbore. The downhole tool includes a housing with a flowline therethrough, a downhole unit, and a fluid sensor positionable in the housing. The fluid sensor includes an insulative base positionable in the downhole tool, a conductive shield positionable on the insulative base, and a plurality of electrodes having a non-conductive coating thereon. The method also involves 892—passing a fluid through the flowline and past the plurality of electrodes, and 894—measuring downhole parameters of the downhole fluid with the electrodes. The method may be performed in any order and repeated as desired.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Although only a few example embodiments have been described in detail above, those skilled in the art will readily appreciate that many modifications are possible in the example embodiments without substantially departing from the spirit of this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A fluid sensor for a downhole tool that comprises a housing with a receptacle and a flowline therethrough, the fluid sensor comprising:

a polymeric insulative base positionable in the receptacle, wherein the polymeric insulative base comprises a flowline passage that extends the flowline through the polymeric insulative base;

a metallic conductive shield positionable with one or more sealing devices to seal the polymeric insulative base in the receptacle; and a plurality of electrodes, wherein each of the plurality of electrodes comprises a sensing element and a pin, wherein the sensing element is disposed in the polymeric insulative base for electrical isolation from one or more other sensing elements and for fluid communication with the flowline passage, and wherein the pin passes through the metallic conductive shield and is electrically isolated from the metallic conductive shield by an insulative coating.

2. The fluid sensor of claim 1, further comprising at least one centralizer support between the polymeric insulative base and the metallic conductive shield.

3. The fluid sensor of claim 1, further comprising at least one centralizer.

4. The fluid sensor of claim 1, further comprising a cap that protects and retains the fluid sensor in the downhole tool.

5. The fluid sensor of claim 1, further comprising a molded insulative collar.

6. The fluid sensor of claim 1, further comprising a glass seal located within the metallic conductive shield.

7. The fluid sensor of claim 1, wherein the one or more sealing devices comprises at least one exterior o-ring.

8. The fluid sensor of claim 1, wherein the sensing element comprises a hole therethrough in fluid communication with the flowline.

9. The fluid sensor of claim 1, wherein the sensing element and the pin are integrally formed or welded together.

10. The fluid sensor of claim 1, wherein the plurality of electrodes are linearly or non-linearly positioned along the metallic conductive shield.

11. A downhole tool positionable in a wellbore penetrating a subterranean formation, the downhole tool comprising:

a housing that comprises a receptacle and a flowline therethrough;

a downhole unit; and a fluid sensor positionable in the receptacle, wherein the fluid sensor comprises:

a polymeric insulative base positionable in the receptacle, wherein the polymeric insulative base comprises a flowline passage that extends the flowline through the polymeric insulative base;

a metallic conductive shield positionable with one or more sealing devices to seal the polymeric insulative base in the receptacle; and a plurality of electrodes, wherein each of the plurality of electrodes comprises a sensing element and a pin, wherein the sensing element is disposed in the polymeric insulative base for electrical isolation from one or more other sensing elements and for fluid communication with the flowline passage, wherein the pin passes through the metallic conductive shield and is electrically isolated from the metallic conductive shield by an insulative coating, and wherein the pin operatively connects the sensing element to the downhole unit.

12. The downhole tool of claim 11, further comprising a cell cap that protects and retains the fluid sensor in the downhole tool.

13. The downhole tool of claim 11, further comprising an additional downhole sensor.

14. A method of sensing downhole parameters of a fluid about a wellbore penetrating a subterranean formation, the method comprising:

deploying a downhole tool into the wellbore, the downhole tool comprising a housing with a receptacle and a flowline therethrough, a downhole unit, and a fluid sensor positionable in the housing receptacle, wherein the fluid sensor comprises a polymeric insulative base positionable in the receptacle, wherein the polymeric insulative base comprises a flowline passage that extends the flowline through the polymeric insulative base, a metallic conductive shield positionable with one or more sealing devices to seal the polymeric insulative base in the receptacle, and a plurality of electrodes wherein each of the plurality of electrodes comprises a sensing element and a pin, wherein the sensing element is disposed in the polymeric insulative base for electrical isolation from one or more other sensing elements and for fluid communication with the flowline passage, wherein the pin passes through the metallic conductive shield and is electrically isolated from the metallic conductive shield by an insulative coating;

passing a fluid through the flowline passage via the flowline and past the plurality of electrodes in a manner to provide contact between the plurality of electrodes and the fluid passing through the flowline passage; and measuring downhole parameters of the fluid with the plurality of electrodes.

15. The method of claim 14, further comprising transmitting the measured downhole parameters to the downhole unit or a surface unit.

16. A fluid sensor system for a downhole tool that comprises a housing with a receptacle and a flowline therethrough, the fluid sensor system comprising:

a fluid sensor having:

a plurality of electrodes, wherein each of the plurality of electrodes comprises a sensing element and a pin: and a polymeric insulative base integrally formed with the sensing elements of the plurality of electrodes and a passage therein such that the polymeric insulative base is positionable in the receptacle such that the passage and the sensing elements are in fluid communication with the flowline to pass downhole fluid therethrough to expose the sensing elements to the downhole fluid and wherein each of the pins passes through the metallic conductive shield and is electrically isolated from the metallic conductive shield by an insulative coating and operatively connects a respective one of the sensing elements to a downhole unit whereby parameters of the downhole fluid are measured; and a cell cap positioned with respect to the housing of the downhole tool to protect the fluid sensor and to retain the fluid sensor in the downhole tool.

* * * * *